United States Patent [19]

Yuuki

[11] 4,231,336

[45] Nov. 4, 1980

[54] EXHAUST GAS RECIRCULATION SYSTEM FOR AN INTERNAL COMBUSTION ENGINE

[75] Inventor: Kiyoshi Yuuki, Susono, Japan

[73] Assignee: Toyota Jidosha Kogyo Kabushiki Kaisha, Toyota, Japan

[21] Appl. No.: 31,779

[22] Filed: Apr. 20, 1979

[30] Foreign Application Priority Data

Sep. 12, 1978 [JP] Japan ..... 53/112745

[51] Int. Cl.[3] ..... F02M 25/06

[52] U.S. Cl. ..... 123/568

[58] Field of Search ..... 123/119A

[56] References Cited

U.S. PATENT DOCUMENTS 4,142,491 3/1979 Hibino et al. ..... 123/119 A 4,142,496 3/1979 Saito et al. ..... 123/119 A 4,151,819 5/1979 Inada et al. ..... 123/119 A

*Primary Examiner*—Wendell E. Burns

*Attorney, Agent, or Firm*—Finnegan, Henderson, Farabow, Garrett & Dunner

[57] ABSTRACT

An exhaust gas recirculation system for an internal combustion engine of the back pressure control type which includes a chamber space which is positioned at a middle portion of an exhaust gas recirculation passage and upstream of an exhaust gas recirculation control valve and downstream of an orifice and which is maintained substantially at atmospheric pressure, wherein the orifice is adapted to provide effective opening area which is variable between a substantial partial opening and full opening in accordance with engine temperature.

5 Claims, 2 Drawing Figures

EXHAUST GAS RECIRCULATION SYSTEM FOR AN INTERNAL COMBUSTION ENGINE

BACKGROUND OF THE INVENTION

The present invention relates to an exhaust gas recirculation system for an internal combustion engine.

Conventionally, exhaust gas recirculation in an internal combustion engine for automobiles for the purpose of reducing emission of NOx in the exhaust gases is not performed when the engine is operated in the cold state, so as to avoid deterioration of drivability of the automobile, and is performed only when the engine has been warmed up. However, operation of the engine in the cold state with no exhaust gas recirculation is not desirable, in view of the high emission of NOx in the exhaust gases. In this connection, I contemplate that it is possible to perform exhaust gas recirculation in the cold state operation of the engine, and that it is possible to accomplish an effective reduction of NOx emission while ensuring desirable drivability of the automobile by employing, in the cold state operation of the engine, a non-zero rate of exhaust gas recirculation which is lower than the normal rate of exhaust gas recirculation adopted in the warmed up operation of the engine.

SUMMARY OF THE INVENTION

Therefore, it is the object of the present invention to provide an exhaust gas recirculation system for an internal combustion engine which effects exhaust gas recirculation at a lower rate in the cold state operation of the engine, in addition to the normal exhaust gas recirculation performed in the warmed up operation of the engine, so as further to improve NOx emission over a wide range of operational conditions of the engine.

In accordance with the present invention, the abovementioned object is accomplished by an exhaust gas recirculation system for an internal combustion engine, comprising: an exhaust gas recirculation passage, an exhaust gas recirculation control valve provided at a middle portion of said exhaust gas recirculation passage which has a diaphragm chamber and is adapted to increase its opening as vacuum supplied to its diaphragm chamber increases, a vacuum passage which conducts engine intake vacuum to said diaphragm chamber, an orifice means provided at a middle portion of said exhaust gas recirculation passage which is upstream of said exhaust gas recirculation control valve so as to define a chamber space positioned between said orifice means and said exhaust gas recirculation control valve, a vacuum control valve provided at a middle portion of said vacuum passage which controls level of the vacuum supplied through said vacuum passage to the diaphragm chamber of said exhaust gas recirculation control valve in accordance with the pressure existing in said chamber space, and an orifice control system which provides a substantial basic opening area in said orifice means and increases opening area of said orifice means so as to be larger than said basic opening area when engine temperature is above a predetermined value.

In this connection, an exhaust gas recirculation system which comprises an exhaust gas recirculation passage, an exhaust gas recirculation control valve provided at a middle portion of said exhaust gas recirculation passage which has a diaphragm chamber and is adapted to increase its opening as vacuum supplied to its diaphragm chamber increases, a vacuum passage which conducts engine intake vacuum to said diaphragm chamber, an orifice means provided at a middle portion of said exhaust gas recirculation passage which is upstream of said exhaust gas recirculation control valve so as to define a chamber space positioned between said orifice means and said exhaust gas recirculation control valve, and a vacuum control valve positioned at a middle portion of said vacuum passage which controls the level of the vacuum supplied through said vacuum passage to the diaphragm chamber of said exhaust gas recirculation control valve in accordance with the pressure existing in said chamber space, is known as a back pressure control type exhaust gas recirculation system, which provides a constant exhaust gas recirculation ratio regardless of load on or output power delivered by the engine, if the system is adjusted so that the pressure existing in said chamber space is maintained to be substantially equal to atmospheric pressure. The concept of the present invention, which is also to perform exhaust gas recirculation in the cold state operation of the engine, is realized in an efficient and desirable manner when it is combined with the concept of the back pressure control type exhaust gas recirculation system as defined above, because the ratio of exhaust gas recirculation is readily desirably modifed by controlling the opening area of the orifice means, regardless of load on or output power delivered by the engine.

BRIEF DESCRIPTION OF THE DRAWING

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Figure 1:
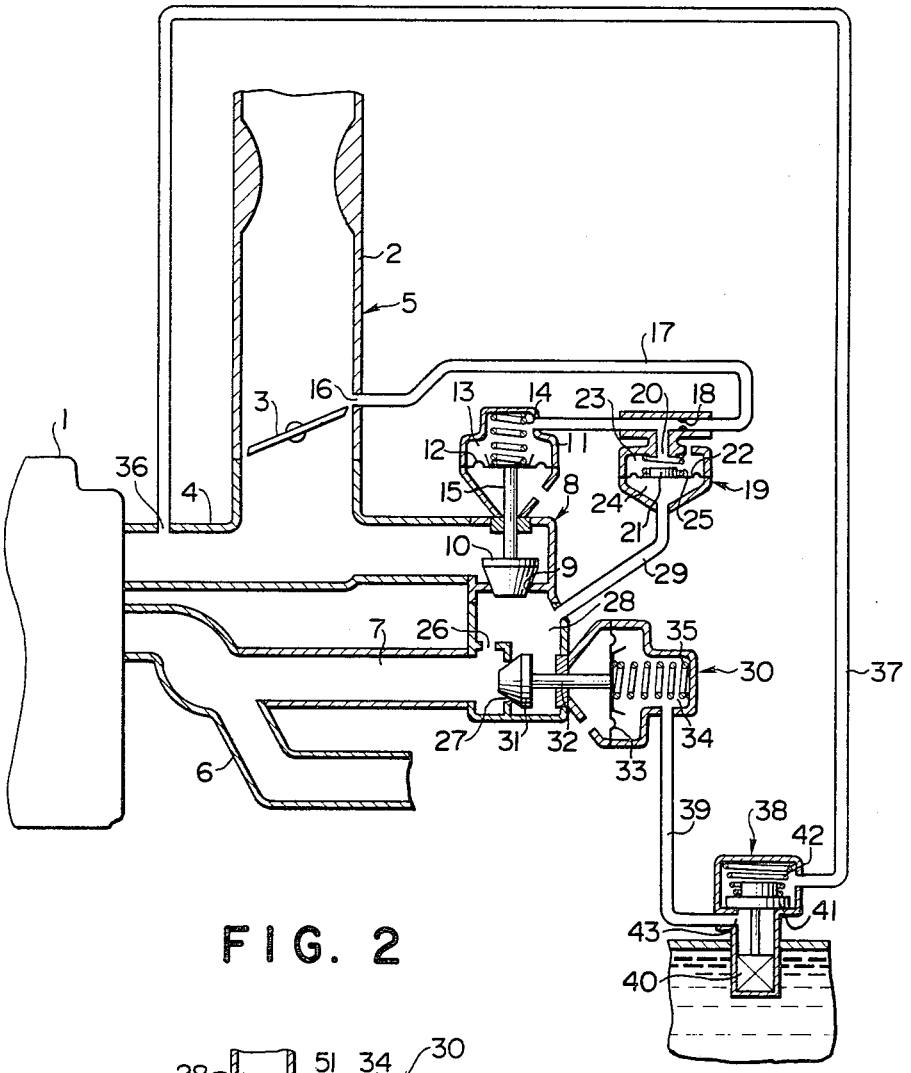
FIG. 1 is a diagrammatical view showing an embodiment of the exhaust gas recirculation system of the present invention.

Referring to FIG. 1, an engine partly shown and designated by reference numeral 1 has an intake system 5 which includes an carburetor 2 having a throttle valve 3 and an intake manifold 4, an exhaust manifold 6, and an exhaust gas recirculation system which comprises a passage means 7 through which a part of the exhaust gases flowing through the exhaust manifold is recirculated toward the intake manifold 4 and an exhaust gas recirculation control valve 8 which controls opening of the passage means 7.

The exhaust gas recirculation control valve 8 has a valve port 9, a valve element 10 which opens or closes the valve port 9, and a diaphragm means 11 which drives the valve element 10. The diaphragm means 11 has a diaphragm 12 which is connected with the valve element 10 by way of a rod 15, a diaphragm chamber 13 defined on one side of the diaphragm, and a compression coil spring 14 which biases the diaphragm 12 downward in the figure so as to urge the valve element 10 toward its valve closing position, i.e. so as to interrupt the exhaust gas recirculation passage. When vacuum above a predetermined level is supplied to the diaphragm chamber 13, the diaphragm 12 is shifted upwards in the figure against the action of the compression coil spring 14, so as to lift the valve element 10 from the port 9, and so as to open the control valve 8 and to establish an exhaust gas recirculation passage. The diaphragm chamber 13 is connected by way of a passage means 17 with a vacuum port 16 which opens to the intake passage of the carburetor 2 at a position which is upstream of the throttle valve 3 when it is in full closed position as shown in the figure and which becomes downstream of the throttle valve when it is opened beyond a predetermined opening.

At middle portions of the passage means 17 are incorporated a throttling element 18 and a vacuum control valve 19. The vacuum control valve 19 comprises a valve port 20, a valve element 21 which opens or closes the valve port 20, and a diaphragm 22 which supports the valve element 21. On the one side of the diaphragm 22 which is connected with the valve port 20 is defined a first diaphragm chamber 23 which is opened to the atmosphere, and on the other side of the diaphragm 22 is defined a second diaphragm chamber 24. The vacuum control valve 19 further comprises a compression coil spring 25 which urges the diaphragm 22 downward in the figure so that, when the pressure difference between those existing in the diaphragm chambers 24 and 23 is below a predetermined value, the port 20 is opened so as to be released to the atmosphere through the diaphragm chamber 23, and, when the aforementioned pressure difference is above a predetermined value, the port 20 is closed by the valve element 21. The diaphragm chamber 24 is connected by way of a passage means 29 with a chamber space 28 which is defined at a middle portion of the exhaust gas recirculation passage 7 which is upstream of the exhaust gas recirculation control valve 8 and which is downstream of orifices 26 and 27. These orifices are provided in the exhaust gas recirculation passage 7 at a middle portion of the passage which is upstream of the exhaust gas recirculation control valve 8.

The exhaust gas recirculation control valve 8, the vacuum control valve 18, and the orifices 26 and 27 co-operate to maintain the pressure existing in the chamber space 28 to be substantially at a constant level such as atmospheric pressure, so that the pressure difference across the orifices 26 and 27 is always equal to the pressure difference across the exhaust pipe system of the engine, and so that the ratio of exhaust gas recirculation is maintained at a constant value which is exclusively determined by the opening area of the orifices 26 and 27, regardless of load on or output power delivered by the engine.

The first orifice 26 is constantly open. The second orifice 27, which is provided in parallel with the first orifice 26, is selectively opened or closed by an orifice control system which includes a vacuum operated diaphragm valve 30, a thermostat valve 38, etc.. The diaphragm valve 30 has a valve element 31 which is actuated by a diaphragm 33 by way of a rod 32 and opens or closes the orifice 27. The diaphragm 33 is constantly urged leftward in the figure by a compression coil spring 35 so as to maintain the valve element 31 in the position to close the orifice 27 unless a vacuum higher than a predetermined level is supplied to a diaphragm chamber defined on one side of the diaphragm 33. The diaphragm chamber 34 is connected with a vacuum port 36 provided to open at the wall of the intake manifold 4 by a passage means 37 and 39 which incorporates therebetween the aforementioned thermostat valve 38.

The thermostat valve 38 has a thermosensitive element 40 such as a thermowax actuator adapted to respond to a temperature, such as the temperature of engine cooling water, which represents engine temperature, so as to operate a valve element 41, so that, when engine temperature is below a predetermined value, the valve element 41 is seated on a valve port 43 by the action of a compression coil spring 42 so as to isolate functionally the passage means 37 and 39 from each other, and, when engine temperature is above a predetermined value, the valve element 41 is driven upward in the figure so as to open the valve port 43 and to connect functionally the passage means 37 and 39 with each other.

The exhaust gas recirculation system shown in FIG. 1 operates as follows:

When the throttle valve 3 is in full closed position as shown in FIG. 1 or is not opened beyond the vacuum port 16, i.e., when the engine is in or around idling operation, no substantial vacuum appears in the vacuum port 16. Therefore the exhaust gas recirculation valve 8 is in closed condition, and no exhaust gas recirculation is performed.

If the throttle valve 3 is opened beyond the vacuum port 16, a substantial intake vacuum appears in the vacuum port 16, and the vacuum is conducted through the passage means 17 towards the diaphragm chamber 13 of the exhaust gas recirculation control valve, under a modification effected by the vacuum control valve 19, whereby the exhaust gas recirculation control valve is opened so as to perform exhaust gas recirculation. In this case, opening of the exhaust gas recirculation control valve is controlled so that the pressure existing in the chamber space 28 should be approximately equal to atmospheric pressure due to modification of the vacuum supplied to the diaphragm chamber 13 which is effected by the vacuum control valve 19 depending upon the pressure existing in the chamber space 28. Thus, as explained above, the ratio of exhaust gas recirculation is exclusively determined by the opening area of the orifices 26 and 27, regardless of load on or output power delivered by the engine.

When engine temperature is above a predetermined value, the thermostat valve 38 is opened, so that the vacuum which appears in the vacuum port 36 is conducted through the passages 37 and 39 to the diaphragm chamber 34 of the diaphragm valve 30, thereby opening the orifice 27. In this case, therefore, exhaust gas recirculation is performed with an exhaust gas recirculation ratio which depends upon the total of the opening area of the orifices 26 and 27. By contrast, when engine temperature is below a predetermined valve 38 is closed and the passage means 37 and 39 are interrupted from each other. In this case, therefore, the diaphragm chamber 34 of the diaphragm valve 30 is maintained at atmospheric pressure even when a substantial engine intake vacuum appears in the vacuum port 36, as long as the engine is not yet warmed up. In this condition, the orifice 27 is closed by the valve element 31, and only the orifice 26 provides exhaust gas recirculation, which is performed at a relatively low ratio when compared with that in the warmed up operation of the engine which is effected through both of the orifices 26 and 27. By this exhaust gas recirculation at a relatively low ratio the emission of NOx in the cold state operation of the engine is reduced, while ensuring a desirable drivability of the automobile.

Figure 2:
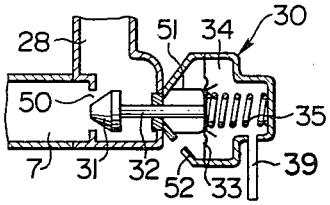
FIG. 2 is a diagrammatical view corresponding to a part of the system shown in FIG. 1, showing a modification of the present invention.

FIG. 2 shows a modification with regard to an essential portion of the system shown in FIG. 1. In FIG. 2 the portions corresponding to those shown in FIG. 1 are designated by the same reference numerals. In this modification, the two parallel orifices 26 and 27 in FIG. 1 are replaced by a single orifice 50, the opening area of which is controlled by the valve element 31 so as to be increased or decreased, except for a substantial basic opening area which is constantly ensured. To ensure this basic opening area, a stop 51 is provided so as to limit the leftward movement of the diaphragm 33 as seen in FIG. 2, even when no vacuum is supplied to the diaphragm chamber 34. Therefore, in the condition shown in FIG. 2, in which no substantial vacuum is supplied to the diaphragm chamber 34, the orifice 50 provides the minimum or basic opening area, and, as the vacuum supplied to the diaphragm chamber 34 increases, the valve element 31 is shifted rightward in the figure so as to increase the effective opening area of the orifice 50. It will be apparent that the modification shown in FIG. 2, when incorporated in the system shown in FIG. 1, operates substantially in the same manner as the embodiment shown in FIG. 1.

Although the invention has been shown and described with respect to a preferred embodiment and a modification thereof, other various modifications, equivalent replacements, and/or omissions of the form and the content of the shown embodiment, without departing from the spirit of the present invention, will be possible for a man skilled in the art. Therefore it should be understood that the illustrative embodiment and its modification have been given for the purpose of explanation only, and are by no means intended to limit the scope of the invention, which is defined by the appended claims.

I claim:

1. An exhaust gas recirculation system for an internal combustion engine, comprising:

an exhaust gas recirculation passage, an exhaust gas recirculation control valve provided at a middle portion of said exhaust gas recirculation passage which has a diaphragm chamber and is adapted to increase its opening as vacuum supplied to its diaphragm chamber increases, a vacuum passage which conducts engine intake vacuum to said diaphragm chamber, an orifice means provided at a middle portion of said exhaust gas recirculation passage which is upstream of said exhaust gas recirculation control valve so as to define a chamber space positioned between said orifice means and said exhaust gas recirculation control valve, a vacuum control valve provided at a middle portion of said vacuum passage which controls level of the vacuum supplied through said vacuum passage to the diaphragm chamber of said exhaust gas recirculation control valve in accordance with the pressure existing in said chamber space, and an orifice control system which provides a substantial basic opening area in said orifice means and increases opening area of said orifice means so as to be larger than said basic opening area when engine temperature is above a predetermined value.

2. The exhaust gas recirculation system of claim 1, wherein said orifice control system comprises a vacuum operated diaphragm valve including a valve element which controls effective opening area of said orifice means and a thermostat valve which responds to engine temperature so as to control supply of vacuum to said diaphragm valve.

3. The exhaust gas recirculation system of claim 2, wherein said diaphragm valve is adapted so as to increase opening area of said orifice means when engine intake vacuum is supplied thereto, and said thermostat valve is adapted so as to conduct engine intake vacuum therethrough when engine temperature is above a predetermined value.

4. The exhaust gas recirculation system of claim 2 or 3, wherein said orifice means has two orifices arranged in parallel with each other, one of which is constantly open, and the other of which is controlled so as to be opened or closed by said diaphragm valve.

5. The exhaust gas recirculation system of claim 2 or 3, wherein said orifice means has one orifice which is controlled so as to be totally opened or partially closed by said diaphragm valve.

* * * * *